US005860897A

United States Patent [19]

Gilbert et al.

[11] Patent Number: 5,860,897

[45] Date of Patent: Jan. 19, 1999

[54] EXERCISE DEVICE

[75] Inventors: Judith Gilbert, New York; Paul Dewsnap, Huntington, both of N.Y.

[73] Assignee: Power Arm, Inc., E. Atlantic Beach, N.Y.

[21] Appl. No.: 972,804

[22] Filed: Nov. 19, 1997

Related U.S. Application Data

[63] Continuation-in-part of Ser. No. 842,229, Apr. 23, 1997.

[51] Int. Cl.[6] ..... A63B 21/02

[52] U.S. Cl. ..... 482/130; 482/123; 482/126

[58] Field of Search ..... 482/121, 123, 482/124, 125, 129, 130, 146, 147, 126

[56] References Cited

U.S. PATENT DOCUMENTS

| | | | |
|---|---|---|---|
| 3,593,994 | 7/1971 | Anbar | 482/147 |
| 3,893,667 | 7/1975 | Snyder, Jr. et al. . | |
| 4,373,716 | 2/1983 | Pagani . | |
| 5,112,287 | 5/1992 | Brewer . | |
| 5,137,503 | 8/1992 | Yeh | 482/125 |
| 5,261,864 | 11/1993 | Fitspatrick | 428/130 |
| 5,269,737 | 12/1993 | Sobotka | 482/130 |
| 5,279,533 | 1/1994 | Yin et al. | 482/123 |
| 5,352,176 | 10/1994 | Huang | 482/146 |
| 5,362,296 | 11/1994 | Wang et al. . | |
| 5,415,609 | 5/1995 | Yang . | |
| 5,480,369 | 1/1996 | Dudley . | |
| 5,605,526 | 2/1997 | Hatfield . | |
| 5,730,688 | 3/1998 | Prusick | 482/130 |

*Primary Examiner*—Lynne A. Reichard
*Attorney, Agent, or Firm*—William Squire

[57] ABSTRACT

A relatively rigid molded thermoplastic sheet seat member has a plurality of longitudinally extending ribs forming channel depressions in the seat surface. An annular flange extends from a depending peripheral wall. Three generally cylindrical projections depend from the seat member bottom surface and each including an annular groove for selectively receiving a plurality of elastomeric straps or bands. The bands are formed into two spaced straps and at one end are secured in spaced grooves of a U-shaped grip bar and at the other end pass through an opening in the seat at the seat rear edge and are looped about the projections to set the distance from the seat to the grip. A strap may secure the seat to a chair. A person sits on the seat which overlies the chair seat during exercising the persons arms. Different embodiments are disclosed.

20 Claims, 6 Drawing Sheets

122
124
128
86
82
126'
126
126'
124
87

82
84
78
86
86

86
13
96'
96'
88
80
90
92
106
13
86
86
82
84

80
78
96'
12
96
106
12
96
102
88
92
90
109

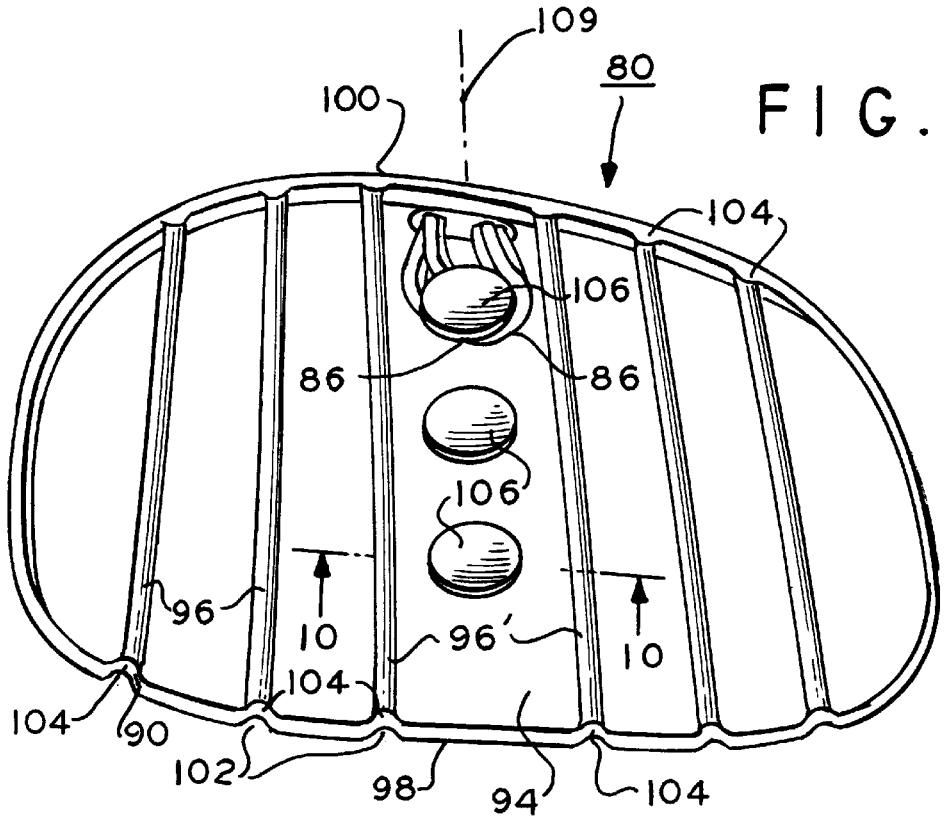
FIG. 9
FIG. 10
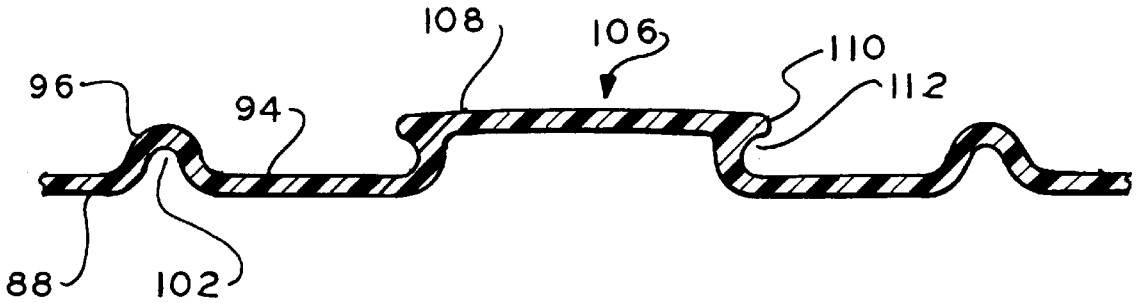

EXERCISE DEVICE

This application is a continuation-in-part of application Ser. No. 08/842,229 filed Apr. 23, 1997, now pending.

This invention relates to exercise devices, and more particularly, to devices in which one or more resilient elongated members are coupled at one end to a seat and at the other end to a gripping member.

Generally, such devices are known. See for example U.S. Pat. No. 3,893,667 which discloses a compact exercise device which serves as a decorative and utilitarian piece of furniture. A frame houses coil springs. A pull cord is attached at one end to a spring and extends out through an opening in the frame. Another pull cord is attached to another spring and extends from a further opening in the frame at 90° to the first pull cord. The openings are tapered to impose a resistance on the movement of the cords therethrough. A similar type of apparatus is disclosed in U.S. Pat. No. 5,261,864.

In U.S. Pat. No. 4,373,716 an exercise device is disclosed comprising a frame portion and a seat portion. The frame portion comprises a rigid tubular element for receiving pedal and other exercise devices and surround the seat portion.

A rigid frame as disclosed therein, as recognized by the present inventors, can damage delicate fabric coverings commonly used on upholstered or cushioned chairs and the like. Therefore, this type of seat portion needs to be used with hard surfaces which are relatively impervious to such damage, such as wooden chairs or a support to cover and protect the chair surface from damage. Further, the seat may slide about the chair surface during use on such a hard surface.

U.S. Pat. No. 5,11,287 discloses a stool-like base having a seat, a frame comprising tubular material and brackets. The seat is attached by brackets and fasteners. Eye bolt receiving members are attached to the frame for receiving a tension member comprising a spring, resilient material and the like at different locations along the frame. A hook or loop attaches the tension member at one end to the eye bolt receiving member. This structure is relatively complex, bulky and costly.

U.S. Pat. No. 5,269,737 discloses an exercise device with a seat bar assembly, a shoulder bar assembly and a strap for connecting the shoulder bar assembly to the seat bar assembly. The seat bar assembly comprises an H-shaped bar assembly with a seat attached thereto. A telescoping resistance pad is on the seat. Strap retaining rings are welded to a cross member. Hooked ends of elastic straps are attached to the rings. A modified seat bar assembly may sit on an exercise bench. The apparatus is relatively complex, bulky and costly.

U.S. Pat. No. 5,279,533 discloses a swivel platform with a detachable backrest and resilient exercise cords. The platform comprises grips at opposite sides, a central stub bottom shaft, a plurality of threaded columns, a rotary table, a central relatively smaller pad on the bottom surface for supporting central portion of the apparatus on the ground. A central sleeve, rolling balls, with a base plate fastened to the seat hold the rotary table and an annular ring-like base plate in place. Screws are used to fasten the assembly together. The elastic cords are attached to plug members. The base plate is an annular ring-like member surrounding the central column and pad. An annular array of projecting elongated stands are attached by screws to the base plate about the central column and pad for supporting the base plate on a support surface. The device is shown as use as a seat or as a support on which a person may stand on a floor surface.

The present inventors recognize that this apparatus is relatively costly and complex. Further, the apparatus could damage conventional fabric covering of upholstered furniture if placed thereon. To use the apparatus on a floor is relatively uncomfortable for a user.

U.S. Pat. No. 5,362,296 discloses a chair mounted exercising unit. This unit will permanently damage such a chair and therefore needs to be dedicated to the chair. The unit is also complex and bulky. The present inventors believe damage to an existing chair is not desirable.

Still other devices are shown in U.S. Pat. Nos. 5,415,609, 5,480,369 and 5,605,526. These are all special purpose stand alone exercise apparatuses, relatively complex and not particularly useful with conventional delicate fabric covered upholstered seats.

An exercise device according to the present invention is for placement on a chair seat and comprises a molded integral one piece homogeneous thermoplastic relatively thin sheet seat member having a peripheral edge and opposing broad surfaces, the seat member for resting on and supported by the seat and for receiving the posterior of a seated person. At least one elongated resilient member is included having opposing ends. A coupling means attaches one end of the at least one resilient member to the seat member. A manually engagable grip is secured to the other end of the resilient member.

In one embodiment, the seat member has a bottom broad surface for resting next adjacent to the seat, the coupling means including at least one projection depending from the bottom surface.

The seat member may have an opening therethrough adjacent to the edge for receiving and passing therethrough the at least one resilient member.

In a further embodiment, the seat member broad surfaces respectively form a bottom and a top surface, the device including a plurality of reinforcing ribs extending thereacross and depending from the bottom surface.

Further, the seat member may be contoured to receive the posterior of a person.

The device may include at least one strap coupled to the seat member for releasably securing the seat member to the chair.

In a further embodiment, the grip has at least one recess corresponding to and for receiving the at least one resilient member.

The grip may comprise a rigid elongated cylindrical member with the at least one recess annularly formed therein and a resilient outer gripping cover spaced from the at least one recess.

Further, the seat member may have a rear peripheral edge, the seat member having a through opening for receiving the elongated member adjacent to the rear peripheral edge.

A plurality of the at least one resilient member and an array of spaced projections molded one piece with the seat member may be included in a further embodiment, each projection for releasably receiving and for setting the length of the plurality of at least one resilient member, each of the plurality of the at least one resilient member for being secured to the same projection.

Figures 6, 7, 7A, 8:
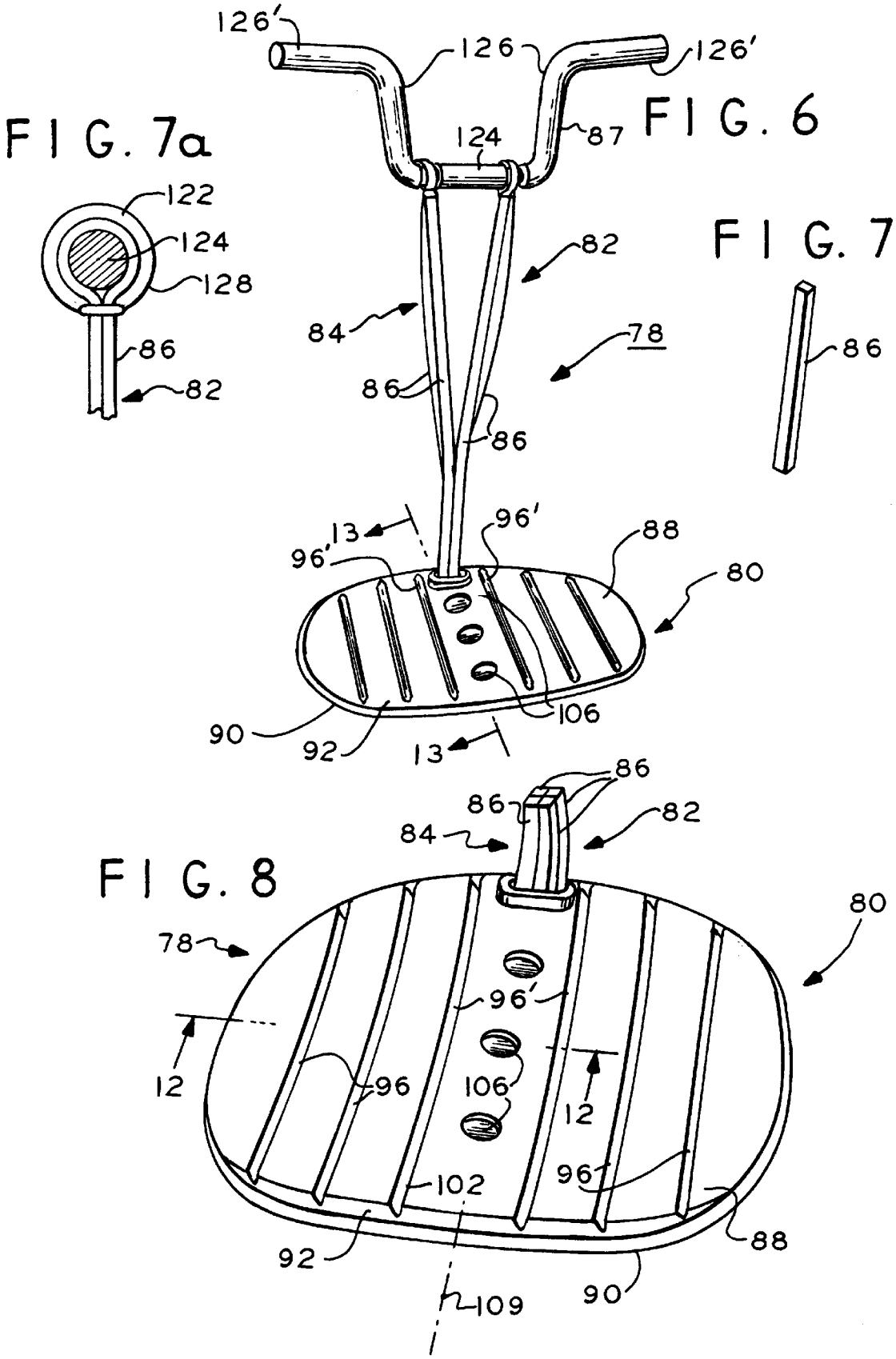
FIG. 6 is a perspective view of an exercise device according to a fourth embodiment of the present invention.
FIG. 7 is an isometric view of an elastic band used in the embodiment of FIG. 6.
Figure 11:
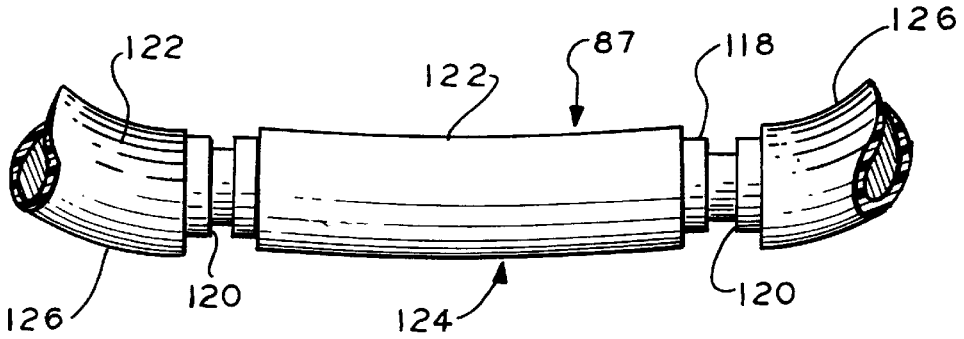
Figure 12:
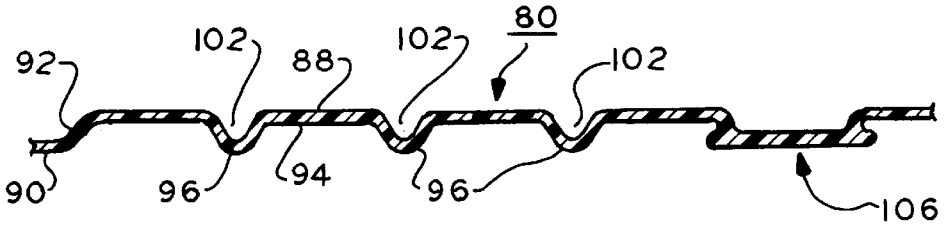
Figure 13:
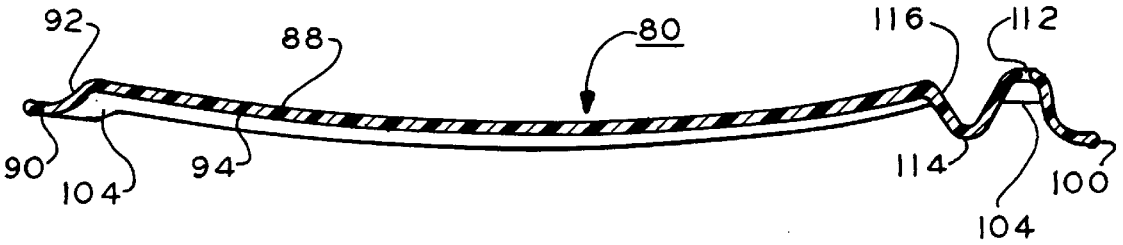

FIG. 7*a* is a fragmentary transverse elevation section view of the grip of FIG. 6 illustrating the attachment of the elastic band;

FIG. 8 is a perspective view showing in more detail the top surface of the seat portion of the exercise device of FIG. 6;

FIG. 9 is a perspective view of the bottom surface of the seat portion of the exercise device of FIG. 8;

FIG. 10 is a sectional elevation view of the seat portion of FIG. 9 taken along lines 10—10;

FIG. 11 is an elevation view of a portion of the grip of the embodiment of FIG. 6;

FIG. 12 is an elevation sectional view of the seat portion of FIG. 8 taken along lines 12—12; and FIG. 13 is an sectional view of the seat portion of FIG. 6 taken along lines 13—13.

Figure 1:
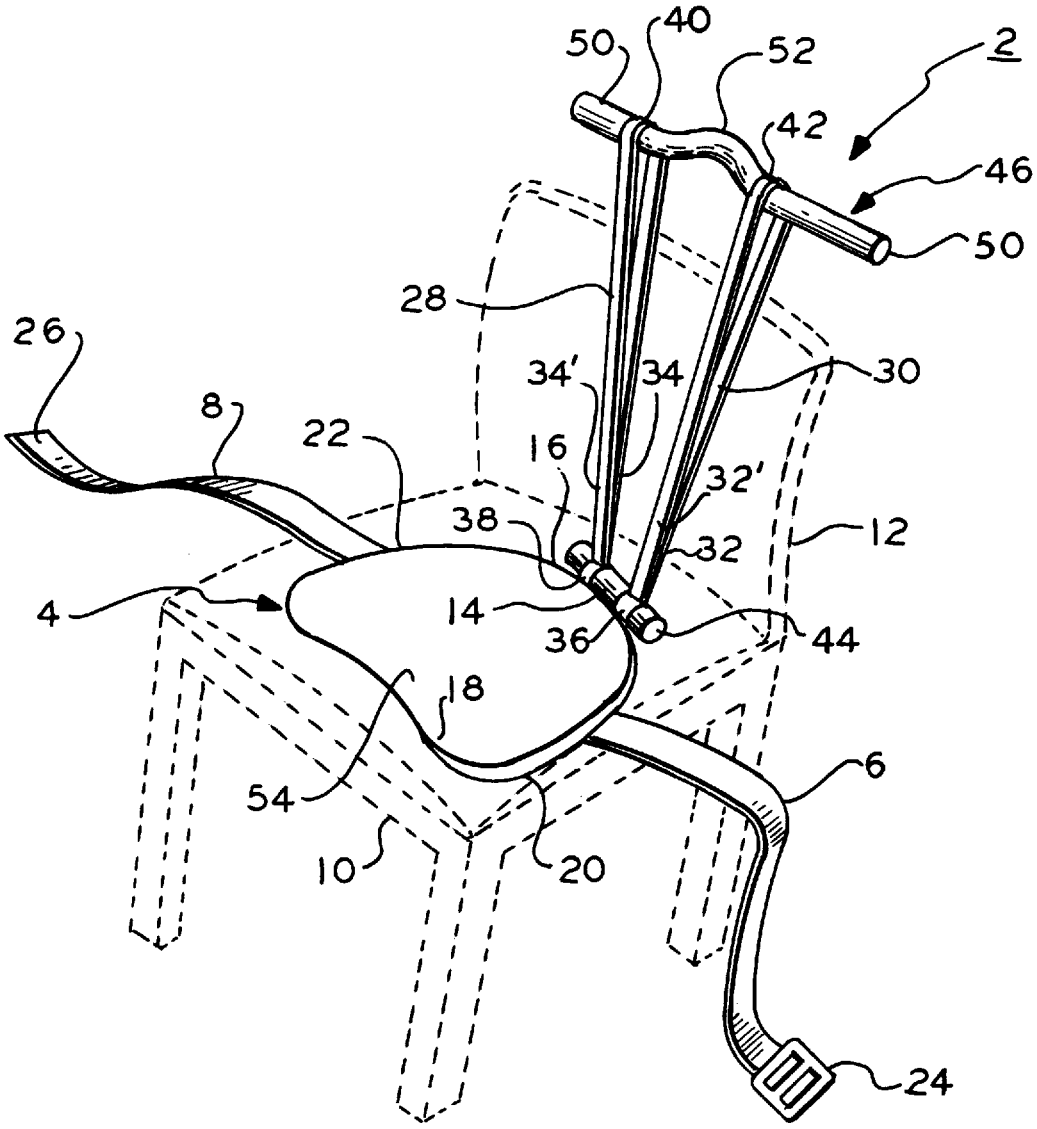
FIG. 1 is an isometric view of an exercise device according to one embodiment of the present invention.

In FIG. 1, exercise device 2 comprises a flexible generally planar seat cushion 4, a pair of straps 6 and 8 for securing the cushion 4 to the seat 10 of a chair 12, shown in phantom, A cloth or other material, such as a metal or plastic, or cord and so on, loop 14 is attached to an edge 16 of the cushion 4. The cushion 4 has a plurality of peripheral edges 16, 18, 20 and 22.

Strap 6 is sewn or otherwise attached to edge 20 and strap 8 is sewn or otherwise attached to the opposite edge 22. The strap 6 includes a buckle 24 for receiving and securing the end 26 of strap 8. In the alternative, the straps 6 and 8 may be a one piece member attached to a surface of a single ply cushion 4 or passing through the cushion 4 interior when assembled of multiple plies.

A pair of elastic elongated or otherwise resilient members 28, 30 shown as elastic bands have the respective corresponding ends 32, 32' and 34, 34' attached together such as by binding with a cord, adhesive and so on forming corresponding loops 36 and 38. The members 28, 30 may be an endless loop or an elongated member tied at its ends, square or circular in section, bungee cords, coil springs and so on. The midsection of respective members 28 and 30 form loops 40 and 42.

A rigid elongated bar or rod 44 passes through the elongated members 28, 30 end loops 14, 36 and 38 securing the ends 32, 32' and 34, 34' of the members 28, 30 to the edge 16 of the cushion 4. The rod 44, which is optional, preferably has about the same diameter as the loops 14, 36 and 38 for closely being received thereby so the loops retain the rod 44 therein by friction. The rod may be a circular cylinder and may have other shapes and does not necessarily have to be rigid. For example, any elongated member, whether or not rigid, such as a cord or the like (not shown), may be used for the same function. In the alternative, the elongated members 28 and 30 may be directly connected to loop 14.

Figure 4:
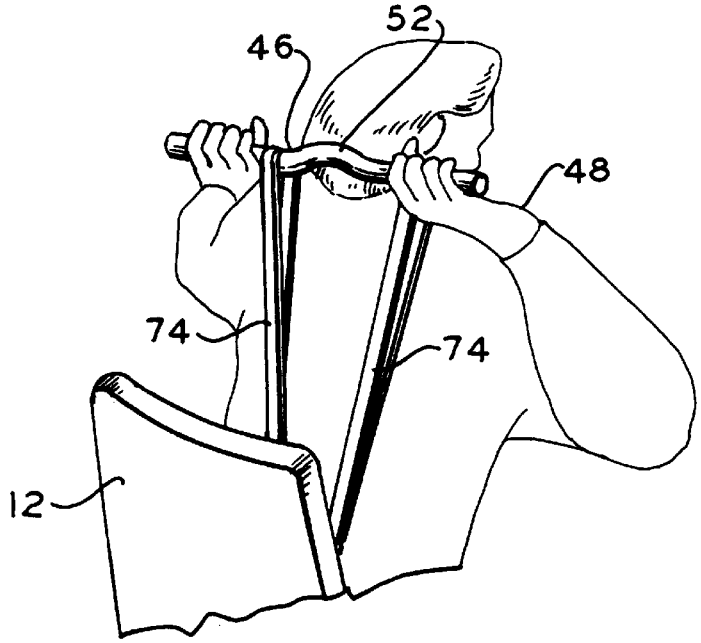
FIG. 4 is a perspective view of a person using the device of FIG. 2.

An exercise manually gripping bar 46, which preferably is a circular cylindrical rod, is passed through the loops 40 and 42. The bar 46 is preferably short, e.g., shorter than the length of the breadth of a person 48 across the shoulder region from shoulder to shoulder as illustrated in FIG. 4. The bar 46 thus terminates at its ends 50 in use aligned with a person's shoulders as shown. The bar 46 has a central somewhat V-shaped bend 52. This bend keeps the loops 40 and 42 spaced apart at the opposing bar 46 ends 50. The bar 46 may be any rigid material such as metal or thermoplastic.

The cushion 4 may be commercially available and preferably comprises a relatively sturdy fabric 54, woven, or compressed fibers or fibrous material such as a matting or felt, af locked substrate fabric such as a velour and the like, a fur whether or not natural or synthetic and so on, The fabric 54 may be a single ply or multiple plies. If multiple plies it may be filled with typical commercially available fillers such as cotton, synthetic fibers, feathers or any combination thereof.

If multiple plies, the cushion is preferably sewn at its edges and the loop 14 and straps 6 and 8 secured simultaneously thereto by sewing or any other sturdy fastening device such as buttons, hook and eyes, snaps, hook and loop material known as Velcro and so on. The straps 6 and 8, if one piece, may pass through and between the plies within the cushion 4 so as to be partially hidden at the central portion within the cushion 4.

While a single loop 14 is shown for attaching the rod 44, multiple loops may be used in the alternative. The number and location of such loops is not important, except that the more loops used the relative strength is increase generally for a given material and fastening technique. The loop 14 may also be attached to the underside of the cushion 4 according to a given implementation.

The cushion 4 top surface material may be a fabric or thermoplastic and may be of different material than the bottom surface abutting the chair 12. For example, the top surface material may be a decorative fabric or a somewhat rigid plastic sheet member. The bottom surface may be a flocked or rigid smooth surfaced molded plastic material whereas the top surface may be a woven material, e.g., the same material as the covering surface of the seat 10.

The bottom of the cushion abutting the seat 10 is preferably sufficiently soft in this embodiment, preferably pliable and flexible, but may be rigid but of smooth material so as to not catch and damage a fabric covered chair on which seat 10 is placed, so as to cause negligible damage to the seat 10 covering regardless its delicate nature. Such material may include, for example, cotton flannel cloth, felt or napped fabric or cloth such as fleece made of polyester or other material, fur natural or synthetic, velours and so on which are relatively sturdy for repetitive use and are relatively harmless when sat on over a delicate upholstered seat fabric.

The cushion is preferably relatively flexible so as to conform to a cushioned seat 10 over a broad surface. This is to minimize damaging the upholstered seat fabric or otherwise dig into the seat covering material which digging might stretch or tear that material. This is especially true for relatively soft seats 10 which may comprise stuffed or spring loaded supports covered by a delicate fabric such as fine silk or a fine polyester weaves. The threads of such fabrics might catch or otherwise easily snag on any rough or harsh protrusions or surface which may sharply penetrate the fabric, even at a relatively small local spot. The cushion has a relatively broad surface which faces and abuts the set 10 to distribute the load thereon to further minimize damage to the seat 10.

Figure 2:
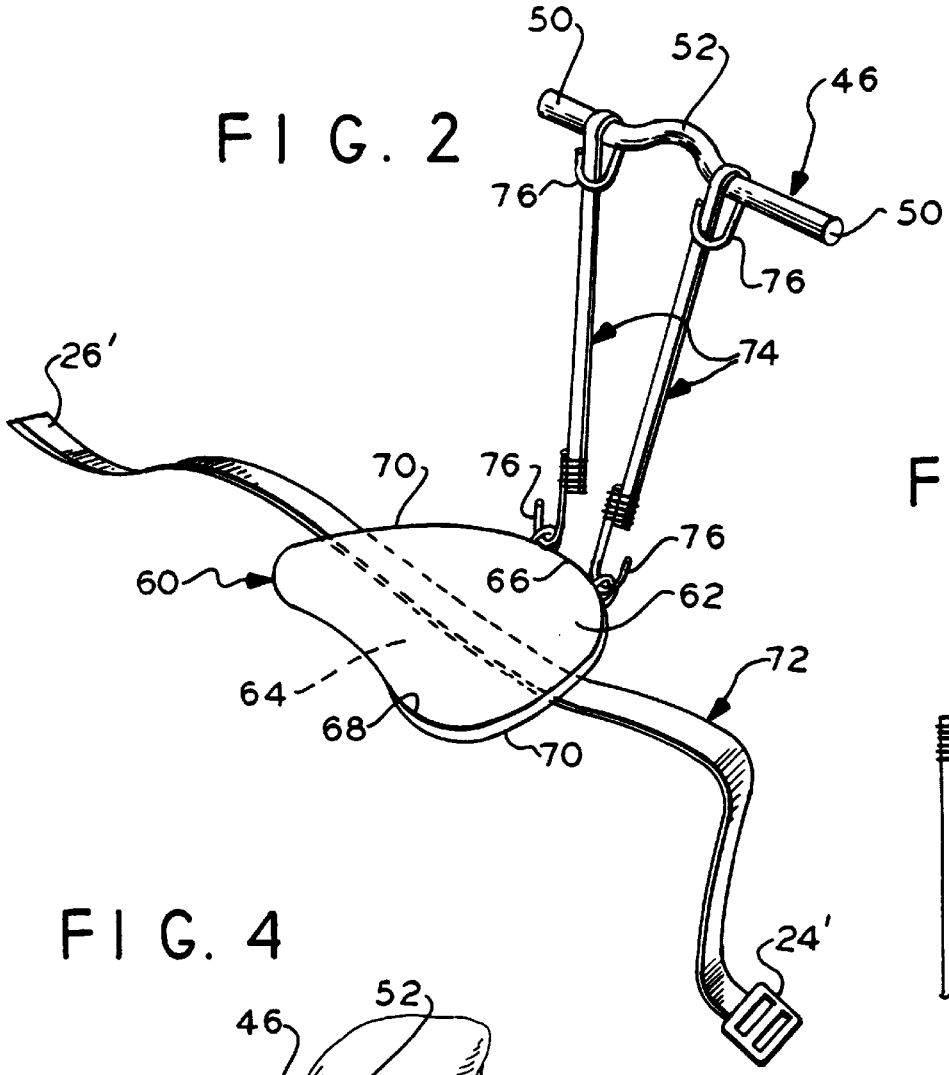
FIG. 2 is an isometric view of an exercise device according to a second embodiment of the present invention
Figure 3:
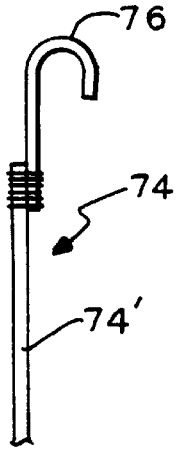
FIG. 3 is a sectional elevation view of the end of one end of a resilient tension rope member used in the embodiment of FIG. 1.

In FIG. 2, device 60 comprises a cushion including multiple plies 62 and 64 of a fabric sewn at the edges 66, 68 and 70 in a continuous seam. Strap 72 is a woven type single piece construction which passes between the plies 62 and 64 and sewn thereto at edges 70. The ply 62 may be cloth and the ply 64 may be a rubber, felt, fur or fabric. The resilient members 74 are identical and comprise commercially available bungee cords each comprising an elastic cord 74' and a metal hook 76 secured at each end of the cords 74', FIGS. 2 and 3.

In use of the devices of FIGS. 1 and 2, a person 48, FIG. 4, sits on the cushion 4 or 64 which is secured to the chair seat 10, FIG. 1, by the straps 6 and 8, FIG. 1 or strap 72, FIG. 2, which strap is wrapped about the seat 10. The resilient members 28, 30, FIG. 1 and 74, FIG. 2, are located to the rear of the person 48. The person grasps the ends 50 of the bar 46 and stretches the resilient members located at the back of the person.

The devices 4 and 60 are relatively simple, low cost and attractive for use. Most importantly no damage occurs to use with fabric covered upholstered chairs and the like.

Figure 5:
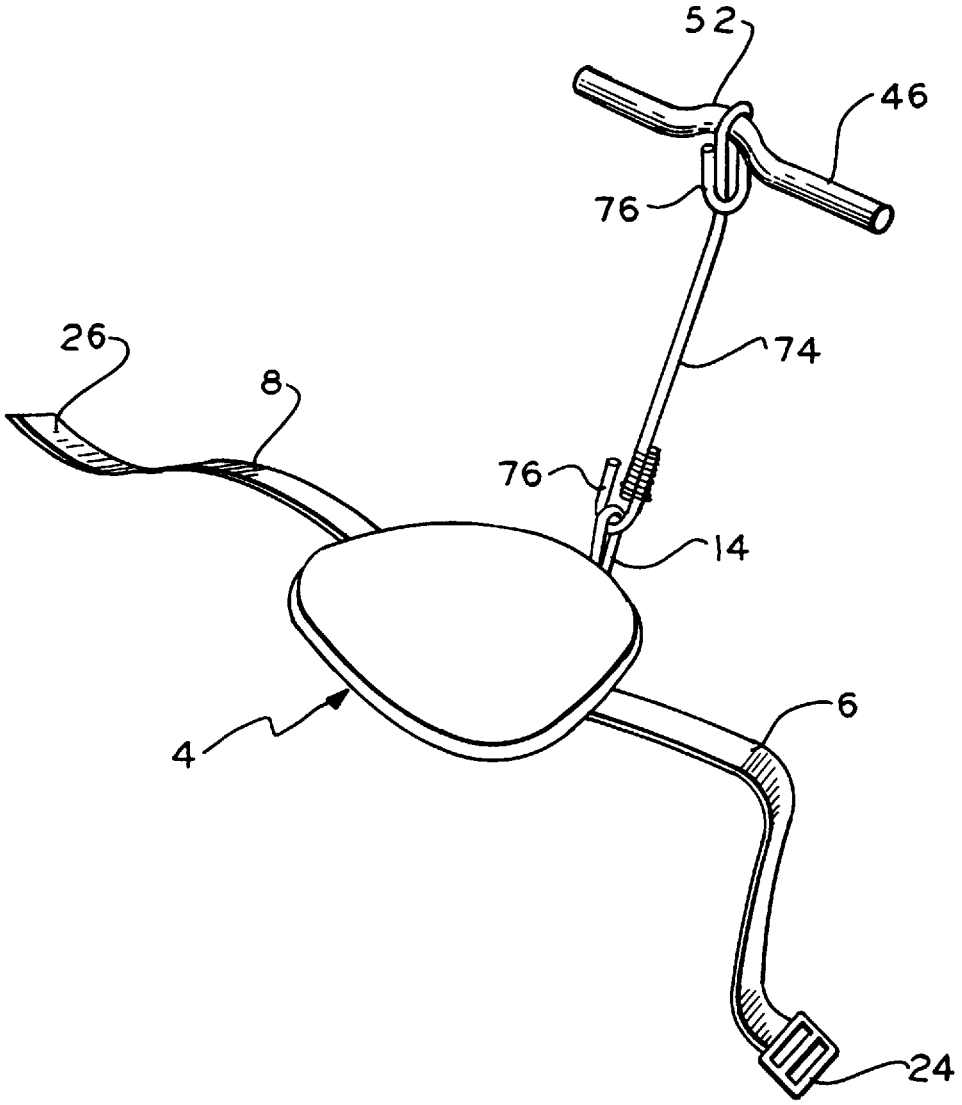
FIG. 5 is an isometric view of an exercise device according to a third embodiment of the present invention.

In FIG. 5, like numerals refer to like structures described above. In this embodiment, a commercially available BUNGEE elastic type cord forming resilient member 74 with a hook 76 at one end is engaged with the single loop 14 secured to cushion 4. The other end of the cord 74 hook 76 is secured to the bend 52. Different BUNGEE cords may be provided with corresponding different lengths for different persons and different resistances to set the desired tension therein as desired.

In the alternative, the resilient members may comprise a first non-extendible cord, not shown, attached to an end of a central coil spring, not shown, and to loops 14 or 36, 38. A second such non-extendible cord is attached to the coil spring at its other end and to the bar 46 in a manner similar to members 28, 30 or 74. In a further embodiment, extendible resilient cords in series with one or more coil springs amy also be used as a resilient member.

In FIGS. 6–13, a further fourth embodiment is shown for an exercise device according to the present invention. Device 78 comprises a unitary integral one piece homogeneous relatively rigid molded thermoplastic seat 80, two sets 82 and 84 of endless elastic identical straps 86, and a manually grasped grip 87, the straps 86 of the sets 82 and 86 being attached at one end at loops therein to grip 88 and the other end to seat 80. Straps 86 as shown in FIG. 7 preferably are square in section, but may be circular as in conventional O-rings (not shown).

Seat 80 is generally flat but is contoured somewhat to receive the posterior of a seating person. The contour comprises a somewhat rounded oblong in plan view and somewhat concave cavity at the top relatively smooth surface 88 of seat 80. The seat 80 is relatively thin sheet thermoplastic material preferably approximately eighth inch thick and molded by injection molding, for example. The seat in plan view is preferably somewhat oval. An annular outwardly extending flange 90 forms the peripheral edge of the seat.

The flange 90 extends radially outwardly from a depending radially outer peripheral wall 92 so that the flange is spaced beneath the plane of the seat sheet material bottom surface 94. The wall 92 and flange 90 thus form a reinforcing rib at the seat 80 periphery.

Molded into the seat 80 are a plurality of preferably identical in section linearly extending ribs 96. Ribs 96 extend from the front edge 98 to the rear edge 100. The ribs 96 form depression-like channels 102 in the top surface 88. The ribs 96 depend from the bottom surface 94 within the space surrounded by peripheral wall 92. The ribs 96 have smooth outer surfaces and are shallower in height than the outer wall 92 so as to be recessed in the space formed by the outer wall 92. In the alternative, they may be generally coplanar with the outer wall 92 at flange 90. The ribs and flange support the seat 80 on a chair seat in a manner similar to that shown in the FIG. 1 embodiment. However, the bottom surface of the seat 80 is formed of smooth and rounded surfaces so as to not damage or snag fabric covered chairs.

Bosses 104 at the flange 90 on the bottom of the seat overlie a portion of the ribs 96 at the flange region. The ribs 96 strengthen and stiffen the seat 80. The number, spacing and dimensions of the ribs are determined according to a given implementation. The ribs preferably are V-shaped, but may be square or rectangular in transverse section.

Located centrally between the two innermost ribs 96' is an array of circular cylindrical-like projections 106, preferably three in this embodiment, each depending from the bottom surface 94. The projections comprise circular generally cylindrical depressions in the top surface 88 of the seat between the top surface channels formed by ribs 96'. The seat is generally of uniform thickness through out. The ribs 96' next adjacent to the projections are preferably spaced further apart than other adjacent ribs to provide room for the projections 106. The array of projections 106 preferably extend in linear spaced relation from the front edge 98 to the rear edge 100 on axis 109.

In FIG. 10, representative projection 106 comprises a circular disc like top surface 108 with a radially outwardly extending lip 110. Lip 110 forms a circular recess 112 about the projection 106. The recess 112 receives the elastic straps 86 which are releaseably wrapped thereabout as shown in FIG. 9.

As best seen in FIG. 13, an opening 112 is preferably molded into the seat adjacent to the flange 90 and wall 92 at the rear edge 100. The opening 112 is formed by a boss 114 formed in the seat top surface 88 and depending from the top surface 88. The boss 114 forms a somewhat U-shaped channel 116 and depends into the space surrounded by wall 92. The opening 112 is generally linear normal to axis 109. The opening 112 receives the sets 82 and 84 of straps 86 which pass therethrough. The opening 112 is optional, and in the alternative a recess in the wall 92 and flange 90 at the rear edge may also be used to receive and locate the sets of straps. Such a recess is also optional. The opening and recess are both adjacent to the rear edge of the seat 80.

In FIG. 11, the grip 87 comprises a preferably generally U-shaped circular cylindrical core bar 118 preferably made of thermoplastic or metal. The bar 118 has a pair of spaced circular grooves 120 in the central segment 124. The bar 118 is encased by an outer preferably soft elastomeric, thermoplastic or other material manually gripping sheath 122. In FIG. 6, the grip 87 includes central segment 124 and two oppositely spaced upright handle-like bars 126 forming a generally U-shaped elongated member somewhat in the shape of conventional bicycle handle bars.

In FIG. 7*a,* straps 86 are formed into circular loops 128 and secured in the grooves 120 of the grip 87 by sliding ring collar 130. In the alternative, collar 130 may be fastened, e.g., swaged, in place. Two straps 86 of each set wrap about the bar 118 in each groove 120.

The seat 80 is sufficiently small in dimensions so as to fit and overly the seat of a chair 12 as shown in the FIG. 1 embodiment. Optionally, straps for securing the seat 80 to the chair may also be provided as shown in FIG. 1. Normally, the weight of a person holds the seat 80 in place during use.

In operation, the user attaches the straps 86 to one of the projections 106 according to the desired length of the straps between the seat 80 and grip 87. The straps are passed through the opening 112 (FIG. 13) to locate the straps at the rear edge of the seat 80 on the axis 109 directly to the rear of the person using the device. The opening 112 also spaces the straps from the back of the user in use while the user sits somewhat forward of the straps. The weight of the user at the user posterior sitting on the device holds the device firmly to the chair seat.

The user grasps the grip 87 with each hand behind the back and raises and lowers the hands to exercise the user's arms.

In a further embodiment, the device seat may comprise a cushion of thermoformed vinyl over a urethane foam core with a non-skid bottom surface comprising an elastomeric material or the like (not shown). While the ribs 96 are shown extending from front to rear, they may also extend transversely normal to the direction shown in FIG. 6 in a flatter further embodiment. The ribs also may extend partially across the broad seat 80 surface. In addition, no peripheral wall need be provided.

In the alternative, a front depending retainer wall or lip may depend only from the seat front edge. This edge also may be generally linear with a curved rear seat end edge coplanar with the broad surfaces merging into two spaced linear side edges also coplanar with the broad surfaces.

The elastomeric straps may comprise endless O-ring type members secured to a central single annular groove in the grip instead of spaced grooves. The force of the elastic bands may be further adjusted by providing more or fewer such bands. Such bands may be connected to the seat by a yoke (not shown) which may be wire formed. The yoke is then attached to a belt-like adjustable strap buckle somewhat like safety seat belts to vary and set the length of the elastomeric bands between the seat and grip. The grip may be covered with a neoprene foam material. Preferably the handles 126' are aligned vertically with the elastomeric straps 86.

In the alternative, the elastomeric bands may be flat strap-like members (not shown) attached to a common ring-like yoke member (not shown). Further straps (not shown) may be attached to the common yoke member to secure the device to a person about the person's torso or to the back of a chair.

It will occur to one of ordinary skill that the embodiments shown may be modified, and are disclosed by way of illustration and not limitation. The scope of the invention is defined by the appended claims.

What is claimed is:

1. An exercise device for exercising the arms of a person and for placement on a chair seat, said device comprising:

a sheet material seat member having a peripheral edge and opposing broad surfaces, said seat member for resting on and supported by the seat and for receiving the posterior of a seated person;

at least one resilient member extending in an axial direction and resilient in the axial direction and having opposing ends;

a coupling means for attaching one end of the at least one resilient member to said seat member;

a manually engagable grip secured to the other end of the resilient members said broad surfaces forming a bottom surface and a top surface; and a plurality of reinforcing ribs depending from and extending across said bottom surface.

2. The device of claim 1 wherein said coupling means includes at least one projection depending from the bottom surface.

3. The device of claim 1 wherein the seat member has an opening therethrough adjacent to said edge for receiving and passing therethrough the at least one resilient member.

4. The device of claim 1 wherein the seat member is contoured to receive the posterior of a person and is relatively smooth and snag free on a bottom surface facing the chair seat.

5. The device of claim 1 further including at least one strap coupled to the seat member for releasably securing the seat member to the chair.

6. The device of claim 1 wherein the grip has at least one recess corresponding to and for receiving said at least one resilient member.

7. The device of claim 6 wherein the grip comprises a rigid elongated cylindrical member with said at least one recess annularly formed therein and a resilient outer gripping cover spaced from the at least one recess.

8. The device of claim 1 wherein the elongated resilient member comprises a resilient strap with a loop at each strap end, one loop for engaging said coupling means and the other loop for engaging said grip.

9. The device of claim 1 wherein the seat member has top and bottom surfaces, said coupling means comprising an array of projections molded one piece with and extending from the bottom surface for setting the length of said at least one resilient member from the grip to said seat member.

10. The device of claim 9 wherein the seat member has a rear peripheral edge, said seat member having a through opening for receiving said elongated member adjacent to said rear peripheral edge.

11. The device of claim 1 including a plurality of said at least one resilient member and an array of spaced projections molded one piece with said seat member, each projection for releasably receiving and for setting the length of said plurality of at least one resilient member, each of the plurality of said at least one resilient member for being secured to the same projection.

12. An exercise device for resting on a chair seat, said device comprising:

a sheet material member for placement on said seat, said sheet member having a peripheral edge and opposing broad top and bottom surfaces, the top surface for receiving the posterior of a person sitting on said sheet member;

at least one resilient elongated member having opposing ends;

securing means coupled to said sheet member for securing one end of said at least one resilient elongated member to the sheet member so that the at least one elongated member extends from the sheet member adjacent to said peripheral edge; and a manual gripping element at the elongated member end opposite the one ends;

the sheet member having a rear edge and an opening adjacent to the rear edge, said securing means extending from said bottom surface, said at least one elongated resilient member passing through said opening.

13. The device of claim 12 wherein said securing means comprises a projection extending from the bottom surface for releasably receiving said at least one elongated resilient member.

14. The device of claim 13 including an array of said projections.

15. The device of claim 12 including a plurality of said at least one elongated resilient member.

16. An exercise device for resting on a chair seat, said device comprising:

a thermoplastic one piece molded homogeneous sheet member for placement on said seat, said sheet member having a peripheral rear edge and opposing broad top and bottom surfaces, the top surface for receiving the posterior of a person sitting on said sheet member;

a pair of elongated members each having opposing ends;

at least one projection extending from said sheet member bottom surface for releasably securing one end of said pair of resilient elongated members to the sheet member so that the elongated pair of members extend from the sheet member at said rear edge; and a manual gripping member secured to an end of the elongated members at an end opposite the one end.

17. The device of claim 16 wherein the gripping member comprises a bar with a central member and a pair of gripping members secured to the central member at opposite ends of the central member and lying in a plane spaced from the central member, said central member having a pair of spaced annular grooves each for receiving a different one of said resilient members.

18. The device of claim 12 wherein the at least one resilient member is an elastic band.

19. An exercise device comprising:

a sheet member having a peripheral rear edge and opposing broad top and bottom surfaces, the top surface for receiving the posterior of a person sitting on said sheet member;

at least one resilient member having opposing ends;

at least one projection extending from said sheet member bottom surface for releasably securing one end of said at least one resilient member to the sheet member so that the at least one resilient member extends from the sheet member at said rear edge; and a manual gripping member secured to an end of the at least one elongated member at an end opposite the one end.

20. An exercise device comprising:

a sheet material seat member having a peripheral edge and opposing broad surfaces, said seat member for receiving the posterior of a seated person;

at least one elongated member extending in and resilient in an axial direction and having opposing ends;

a coupling means for attaching one end of the at least one resilient member to said seat member; and a manually engagable grip secured to the other end of the resilient member;

the seat member having a rear peripheral edge, said seat member having an opening for receiving said elongated member adjacent to said rear peripheral edge and including means for securing the elongated member to the seat member bottom surface.

* * * * *